US007331392B2

(12) United States Patent
Bosley et al.

(10) Patent No.: US 7,331,392 B2
(45) Date of Patent: Feb. 19, 2008

(54) PRESSURE RANGE DELIMITED VALVE

(75) Inventors: Gordon F. Bosley, Cherry Grove (CA); Bruce Mitchell, Calgary (CA)

(73) Assignee: G. Bosley Oilfield Services Ltd., Cherry Grove, Alberta (CA)

( * ) Notice: Subject to any disclaimer, the term of this patent is extended or adjusted under 35 U.S.C. 154(b) by 188 days.

(21) Appl. No.: 11/161,514

(22) Filed: Aug. 6, 2005

(65) Prior Publication Data

US 2007/0029093 A1 Feb. 8, 2007

(51) Int. Cl.
*E21B 31/00* (2006.01)

(52) U.S. Cl. ..... 166/323; 166/386; 166/319; 166/320; 166/332.1

(58) Field of Classification Search ..... 166/319, 166/320, 321, 372, 155, 373, 386, 332.1
See application file for complete search history.

(56) References Cited

U.S. PATENT DOCUMENTS

| | | | | |
|---|---|---|---|---|
| 3,941,510 | A | | 3/1976 | Morgan |
| 4,036,297 | A | | 7/1977 | Swihart, Sr. |
| 4,149,555 | A | | 4/1979 | Hardesty |
| 4,457,334 | A | | 7/1984 | Becker |
| 4,474,242 | A | | 10/1984 | Upchurch |
| RE31,845 | E | | 3/1985 | Peters |
| 4,554,981 | A | * | 11/1985 | Davies ..... 175/4.52 |
| 4,682,656 | A | | 7/1987 | Waters |
| 4,691,779 | A | | 9/1987 | McMahan |
| 4,708,595 | A | | 11/1987 | Maloney et al. |
| 4,989,828 | A | | 2/1991 | Pellegrino |
| 4,997,160 | A | | 3/1991 | Pellegrino |
| 5,167,282 | A | | 12/1992 | Schneider |
| 5,211,242 | A | | 5/1993 | Coleman et al. |
| 5,253,713 | A | | 10/1993 | Gregg et al. |
| 5,295,403 | A | | 3/1994 | Sibley |
| 5,598,619 | A | | 2/1997 | Rosier |
| 5,622,199 | A | | 4/1997 | Pieper |
| 5,647,573 | A | | 7/1997 | Maynard |
| 5,836,393 | A | | 11/1998 | Johnson |
| 6,148,923 | A | | 11/2000 | Casey |
| 6,152,167 | A | | 11/2000 | Baker |
| 6,170,573 | B1 | | 1/2001 | Brunet et al. |
| 6,296,008 | B1 | | 10/2001 | Boyer |

(Continued)

FOREIGN PATENT DOCUMENTS

| | | |
|---|---|---|
| GB | 2399361 | 9/2004 |

*Primary Examiner*—David Bagnell
*Assistant Examiner*—Brad Harcourt
(74) *Attorney, Agent, or Firm*—Sean W. Goodwin

(57) ABSTRACT

A differential pressure valve has a valve body containing a main piston axially moveable therein to open a fluid inlet to a fluid outlet at preset high pressure and to close at a preset lower pressure. A high pressure trigger piston and a low pressure trigger piston are operable in the main piston to alternately engage and lock the main piston to the valve body in one of the closed and open positions. A ball shifts in a port in the main piston to alternately straddle between at least one annular locking groove in the valve body and a release recess in a respective trigger piston. The ball can shift to alternately reside to straddle the valve body and main piston in the locked position or to straddle the main piston and trigger piston in the unlocked position. The trigger pistons and main pistons are mechanically biased to urge the pistons against the fluid pressure at the inlet.

20 Claims, 11 Drawing Sheets

U.S. PATENT DOCUMENTS 6,325,151 B1 12/2001 Vincent
6,523,613 B2 * 2/2003 Rayssiguier et al. ..... 166/320
6,554,580 B1 4/2003 Mayfield et al.
6,637,510 B2 10/2003 Lee
6,705,404 B2 3/2004 Bosley
6,840,703 B2 1/2005 Blanchard
6,907,926 B2 6/2005 Bosley

* cited by examiner

1. Closed - HP trigger valve locked main piston closed

2. Closed - HP threshold reached - HP trigger shifts to release main piston

3. Open - Main piston opened - HP trigger shifts to inactive position

4. Open - Main piston opened - LP trigger shifts to lock main piston open

5. Open - LP threshold reached - LP trigger shifts to release main piston

PRESSURE RANGE DELIMITED VALVE

FIELD OF THE INVENTION

Embodiments of the invention relate to valves which are actuated by pressure differentials across the valve and more particularly to valves which are operable at high pressure differentials and which can be locked in the open or closed position until a preset threshold pressure triggers actuation to close or open the valve respectively.

BACKGROUND OF THE INVENTION

Valves are known which operate to open or close due to a pressure differential across the valve for a variety of uses. Conventional pressure actuated valves typically open at a first pressure and dynamically close as the pressure drops, throttling the flow through the valve. Further, many conventional valves must be reset other than by pressure, relying on some electrical or other means to reset the valve to a starting open or closed position.

One such use, where it is desirable that a valve remain open for a period of time, and to reset to a closed position under certain conditions, is in the unloading of accumulated water from a gas production wellbore. Another is the periodic lifting of production liquids from a low pressure wellbore using periodic high pressure gas. Further, in the case where the valve is to be situated remotely downhole in a wellbore, it is desirable that control means for the opening and resetting the valve be both simple and reliable.

More particularly in the production of hydrocarbons, particularly from gas wells, the accumulation of liquids, primarily water, has presented great challenges to the industry. As the liquid builds at the bottom of the well, a hydrostatic pressure head is built which can become so great as to overcome the natural pressure of the formation or reservoir below, eventually "killing" the well.

A fluid effluent, including liquid and gas, flows from the formation. Liquid accumulates as a result of condensation falling out of the upwardly flowing stream of gas or from seepage from the formation itself. To further complicate the process the formation pressure typically declines over time. Once the pressure has declined sufficiently so that production has been adversely affected, or stopped entirely, the well night be abandoned or rehabilitated. Most often the choice becomes one of economics, wherein the well is only rehabilitated if the value of the unrecovered resource is greater than the costs to recover it.

A number of techniques have been employed over the years to attempt to rehabilitate wells with diminished reservoir pressure. One common technique has been to shut in or "stop cock" the well to allow the formation pressure to build over time until the pressure is again sufficient to lift the liquids when the well is opened again. Unfortunately, in situations where the formation pressure has declined significantly, it can take many hours to build sufficient pressure to blowdown or lift the liquids, reducing the hours of production. Applicant is aware of wells which must be shut in for 12-18 hours in order to obtain as little as 4 hours of production time before the hydrostatic head again becomes too large to allow viable production.

Two other techniques, plunger and gas lift, are commonly used to enhance production from low pressure reservoirs. A plunger lift production system typically uses a small cylindrical plunger which travels freely between a location adjacent the formation to a location at the surface. The plunger is allowed to fall to the formation location where it remains until a valve at the surface is opened and the accumulated reservoir pressure is sufficient to lift the plunger and the load of accumulated liquid to the surface. The plunger is typically retained at the wellhead in a vertical section of pipe and associated fitting at surface called a lubricator until such time as the flow of gas is again reduced due to liquid buildup. The valve is closed at the surface which "shuts in" the well. The plunger is allowed to fall to the bottom of the well again and the cycle is repeated. Shut-in times vary depending upon the natural reservoir pressure. The pressure must build sufficiently in order to achieve sufficient energy, which when released, will lift the plunger and the accumulated liquids. As natural reservoir pressure diminishes, the required shut-in times increase, again reducing production times. Typically, a gas lift production system for more sustained production of liquid hydrocarbons utilizes injection of compressed gas into the wellbore annulus to aerate the production fluids, particularly viscous crude oil, to lower the density and aid in flowing the resulting gas/oil mixture more readily to the surface. The gas is typically separated from the oil at the surface, re-compressed and returned to the wellbore. Gas lift methods can be continuous wherein gas is continually added to the tubing string, or gas lift can be performed periodically. In order to supply the large volumes of compressed gas required to perform conventional gas lift, large and expensive systems, requiring large amounts of energy, are required. Gas is typically added to the production tubing using gas lift valves directly tied into the production tubing or optionally, can be added via a second, injection tubing string. Complex crossover elements or multiple standing valves are required for implementations using two tubing strings, which add to the maintenance costs and associated problems.

A combination of gas lift and plunger lift technologies has been employed in which plungers are introduced into gas lift production systems to assist in lifting larger portions of the accumulated fluids. For greater detail, one can refer to U.S. Pat. No. 6,705,404 issued Mar. 16, 2004 and U.S. Pat. No. 6,907,926 which issued on Jun. 21, 2005, both of which issued to the applicant Gordon Bosley, the entirety of which are incorporated herein by reference. In gas lift alone, the gas propelling the liquid slug up the production tubing can penetrate through the liquid, causing a portion of the liquid to escape back down the well. Plungers have been employed to act as a barrier between the liquid slug and the gas to prevent significant fall down of the liquid. Typically, the plunger is retained at the top of the wellhead during production and then caused to fall only when the well is shut in and the while the annulus is pressurized with gas. This type of combined operation still requires that the well be shut in and production be halted each time the liquid is to be lifted.

In the case of slant wells or directional wellbores, plunger lift systems are largely inoperable as the plunger will not fall down the wellbore as it does in a vertical wellbore. Thus, one must rely on a form of gas lift alone or on the use of pressure actuated valves, as discussed above, which alternately open and close the production tubing to permit energy stored in the annulus to cause liquids to be lifted to surface. Conventional pressure actuated valves however require complex control mechanisms to permit maintaining the valve in a closed position for sufficient time to build the necessary energy in the annulus to lift the liquids and then to remain open for sufficient time to permit the energy to be discharged into the production tubing for lifting the fluids to surface. Conventional valves for periodic release of gas use springs, diaphragms and bellows to attempt to maintain a pressure differential sufficient to periodically discharge the gas while maintaining the valve in an open position for a sufficient amount of time to lift the liquids. Typically such valves are only capable of maintaining a pressure differential of about 50 psi which is largely insufficient to permit enough gas to sweep liquids to surface.

Clearly, there is a need for a valve which is reliably opened at pressure differentials as great as 400 psi and to be maintained in the open position for a period of time after which the valve is reset to a closed position. Particularly, such a valve would be desired for use in the case of wells having declining natural reservoir pressure, for apparatus and methods that would allow the energy within the annulus to be augmented for lifting the accumulated liquids in the well, without a requirement to shut in the well and halt production and to ensure the valve is controlled to remain open for a sufficient period to effectively discharge the accumulated fluids from the well and then to reset.

SUMMARY OF THE INVENTION

Conventional pressure-actuated valves typically open at a first pressure and undesirably throttle the flow therethrough while closing as the pressure diminishes. Various applications including conventional flow processes at surface and wellbore applications can benefit from full flow between differential pressure thresholds.

Generally a differential pressure valve comprises a valve body having a main piston axially moveable in a piston bore to close and open a fluid outlet in the valve body. The main piston houses a first high pressure trigger piston and a second low pressure trigger piston. The trigger pistons cooperate through ports formed in the main piston wall to alternately engage and lock the main piston to the valve body in one of the closed and open positions. The trigger pistons are operative to lock the main piston in the open position until a first closing threshold pressure is reached and alternatively to lock the main piston in the closed position until an opening or second threshold pressure is reached. The valve body has annular locking grooves formed in the piston bore. The trigger valves have release recesses or more preferably circumferential grooves. A port extends through the main piston between each trigger piston and the piston bore. When each of a locking groove, a release groove and a port align, a locking member or ball can shift to alternately reside to straddle the valve body and main piston (locked position) or to straddle the main piston and trigger piston (unlocked position). Fluid pressure at the fluid inlet urges the trigger pistons axially in their bores balanced against mechanical biasing such as a spring. Fluid pressure at the fluid inlet urges the main piston axially in its bores also balanced by mechanical biasing such as a spring.

Simply, in a preferred instance, the valve is alternately locked in two opposing positions. At a preset high pressure, a HP trigger piston is urged to align its release groove with its port and valve body's locking groove to receive its ball and release main piston from the valve body, to overcome the spring bias, and move to the open position. At the open position, a LP trigger piston's release groove and port align with the locking groove to transfer its ball to lock the main piston and valve body. The LP trigger piston's release groove misaligns from the port to ensure the main piston is locked. At a preset low pressure, the LP trigger piston is spring biased to align its release groove with its port and valve body's locking groove to receive its ball and release main piston from the valve body. The main piston spring bias overcomes the fluid pressure and moves to the closed position. At the closed position, the HP trigger piston's release groove and port align with the locking groove to transfer its ball to again lock the main piston and valve body. The HP trigger piston's release groove misaligns from the port to ensure the main piston is locked.

As one can see, the valve can shift at a specified pressure using the locking arrangement as described above. In the preferred the valve locks open and locks closed. Other applications may only require one locked position.

In a broad apparatus aspect of the invention, a valve body having an inlet and an outlet and a valve bore; a main piston axially movable in the valve bore between an open position wherein the inlet is in fluid communication with the outlet and a closed position wherein the main piston blocks the outlet from the inlet; and a first trigger piston axially movable in a first trigger bore formed in the main piston and in fluid communication with the inlet, the first trigger bore having a first port formed through the main piston to the valve bore and the first trigger piston having a first release groove alternately aligned and misaligned with the first port; a first locking element radially moveable in the first port; and at least one annular locking groove formed in the valve bore; wherein at a first preset fluid pressure at the inlet, the first port is aligned with the at least one annular locking groove, and the first release groove of the first trigger piston is moveable to misalign from the first port, and wherein the first locking element resides in the first port and engages with the at least one annular locking groove for locking the main piston to the valve body in the closed position; and wherein at a second preset fluid pressure at the inlet, the first annular groove of the first trigger piston aligns with the first port wherein the first locking element moves to reside in the first port and engages with the first release groove for releasing the first locking element from the valve body to enable the main piston to move to the open position.

Preferably, the valve further comprises a second trigger piston axially movable in a second trigger bore formed in the main piston and in fluid communication with the inlet, the second trigger bore having a second port formed through the main piston to the valve bore and the second trigger piston having a second recess alternately aligned and misaligned with the second port; and a second locking element radially moveable in the first port; wherein at the opening preset fluid pressure at the inlet, the second port is aligned with the at least one annular main groove, and wherein the second locking element resides in the second port and engages the at least one annular locking groove wherein the second trigger piston is moveable to misalign the second annular groove from the second port for locking the main piston to the valve body in the open position, and at the closing preset fluid pressure at the inlet, the second recess of the second trigger piston can align with the second port wherein the second locking element moves to reside in the second port and engaged with the second release groove for releasing the second locking element from the valve body to release the main piston from the valve body.

Preferably, such as in a wellbore embodiment, the valve is fit to a valve housing forming a production annulus in communication with the valve's fluid outlet which is sealably isolated from the fluid inlet. More preferably, the valve and valve housing further comprise a one-way valve in communication with a first liquid source and which discharges liquid to the production annulus. Further, the valve's fluid inlet is in communication with a second gas source. Therefore, normally liquid flows from the first liquid source and through the one-way valve to the production annulus. Once the gas pressure at the fluid inlet reaches the opening preset, the valve opens routing gas from the second source and through the fluid outlet to the production annulus. The pressure of the gas in the production annulus closes the one-way valve and liquid and gas flow up the production annulus.

DETAILED DESCRIPTION OF THE PREFERRED EMBODIMENTS

Figure 1A:
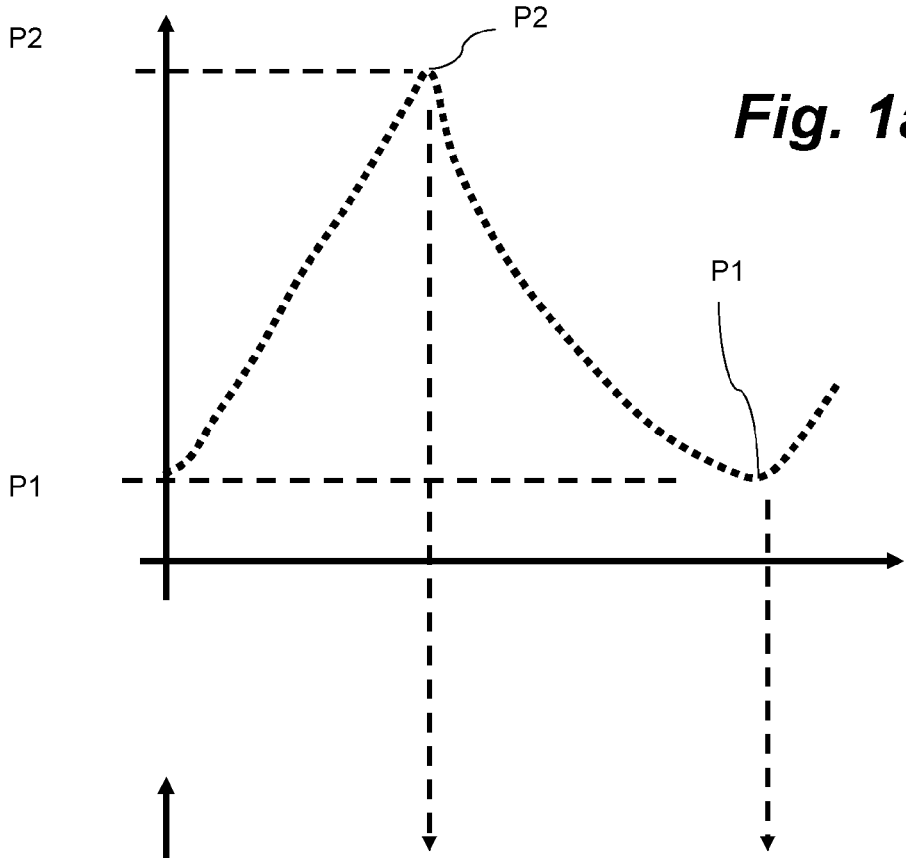
FIGS. 1*a* and 1*b* are schematic representations of the relationship between fluid pressure and valve operation.
Figure 1B:
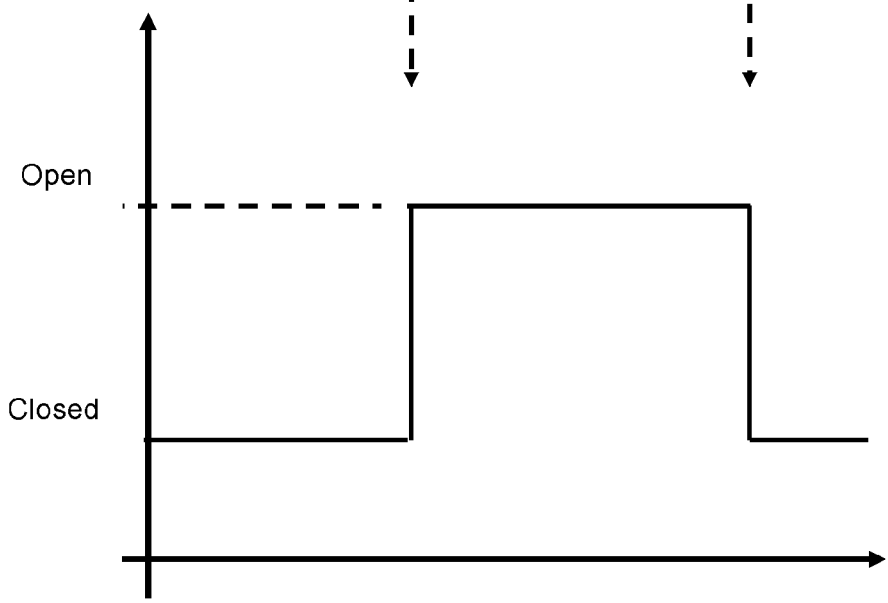

As shown in FIGS. 1*a* and 1*b,* the characteristics of a differential pressure valve 10 are illustrated demonstrating the valve being closed at a first pressure P1 and being open at a second pressure P2. The valve Is otherwise insensitive to changes in pressure. Intermediate transitions, between open and closed positions, the valve is locked in the respective position.

Figures 2A, 3A:
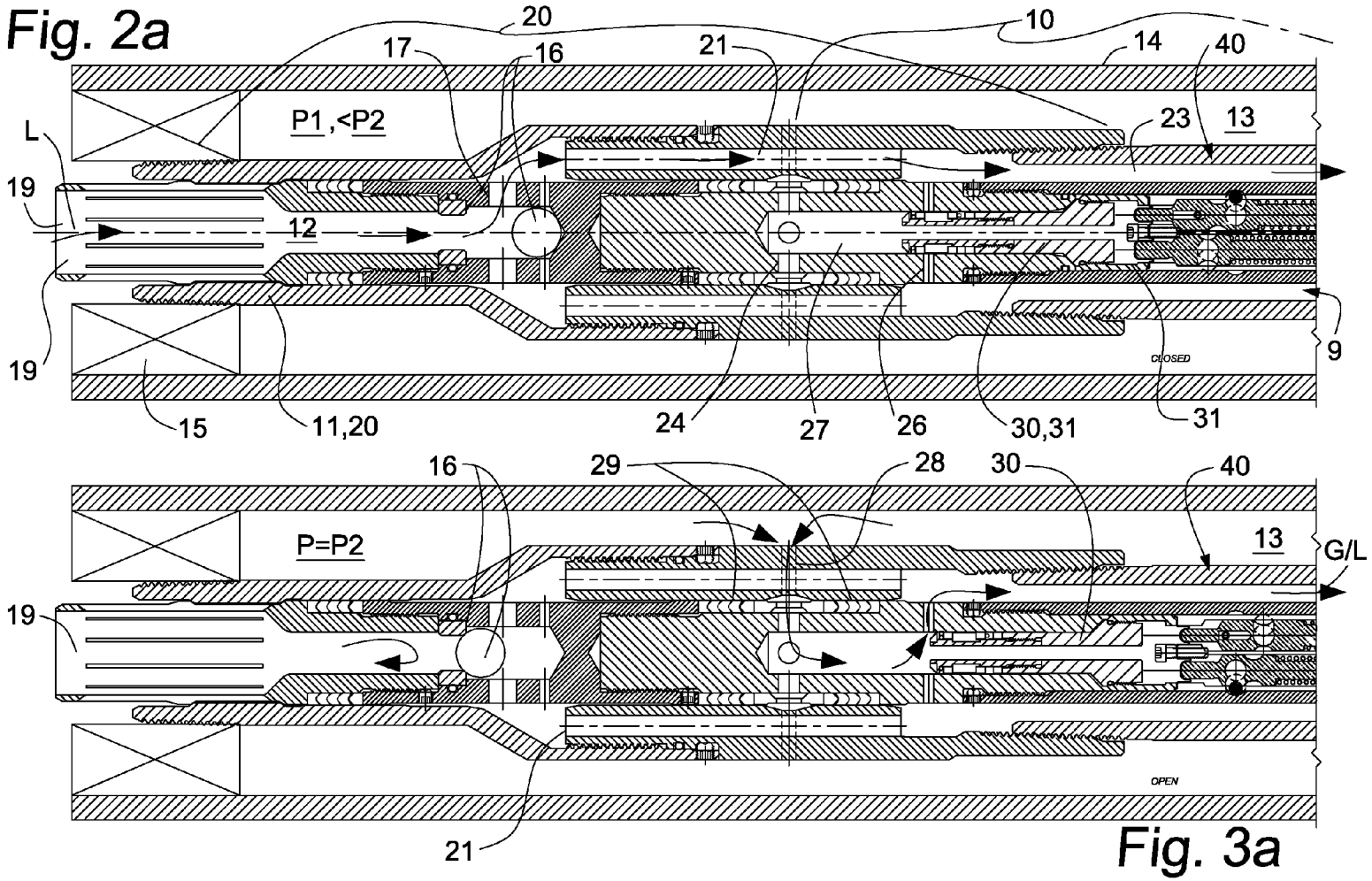
FIGS. 2*a* and 2*b* illustrate the downhole and uphole cross-sectional view of a wellbore implementation of a first embodiment of the valve in the closed position.
FIGS. 3*a* and 3*b* illustrate cross-sectional views of the wellbore implementation of a first embodiment of the valve of FIGS. 2*a*,2*b* in the open position.
Figure 2B:
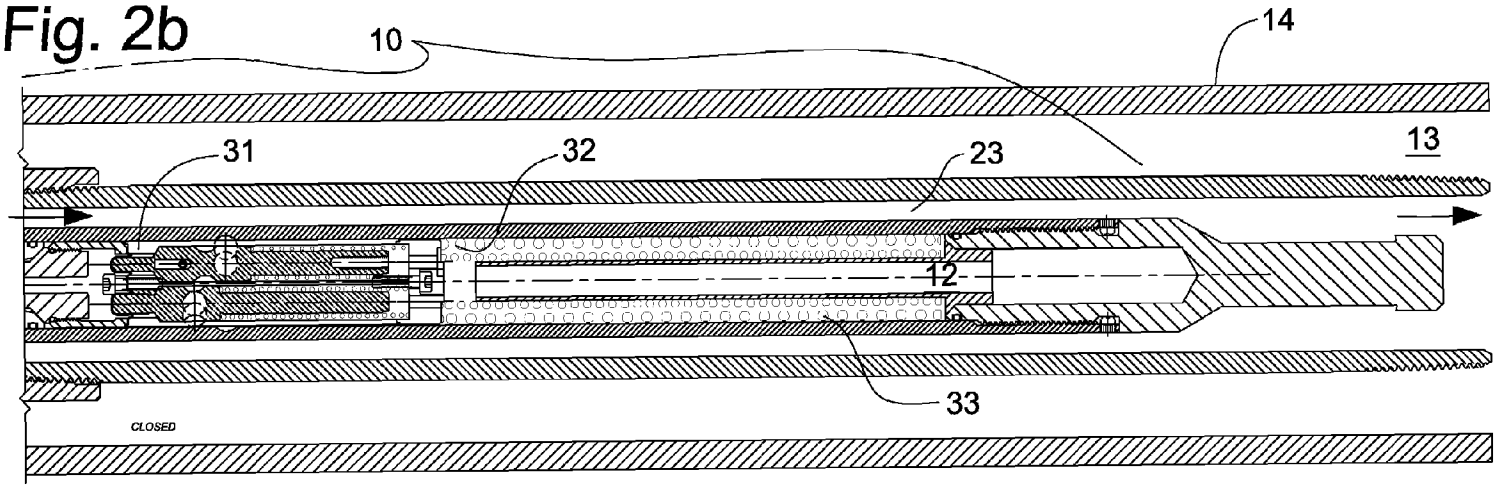

With reference to FIGS. 2*a* and 2*b*, a wellbore implementation is convenient to illustrate the operation of one embodiment of the valve 10 for the control of fluids (L) from a wellbore 9. The valve 10 is illustrated located at a downhole end of a tubing string 11. A wellbore annulus 13 is formed between the tubing string 11 and a casing 14 in the wellbore 9. The tubing string 11 has a bore 12. In this embodiment, a packer 15 seals the wellbore annulus 13 so that wellbore fluid from the wellbore 9 is directed into the tubing string 11 and is isolated from the wellbore annulus 13. In this embodiment, fluid flows from two different sources, the wellbore 9 and the wellbore annulus 13, are controlled through management of the valve 10 under differential pressure control.

As shown in FIGS. 2*a* through 3*b*, in a gas well embodiment as discussed above, it is advantageous to use the wellbore annulus 13 to accumulate gas at an elevated or high pressure (HP) sufficient to effect gas lift of accumulated liquids from the wellbore 9. The nature of the arrangement in this embodiment is that a small compressor can be used to accumulate compressed gas at high pressure over a period of time and avoid the need for high capacity expensive compressors. The valve 10 controls the egress of gas in the wellbore annulus 13 and is operable between two positions, a first production position and a second lift position. In the first production position, while gas is being compressed and stored in the wellbore annulus 13, formation fluids L, from a first source from the wellbore 9, are allowed to flow to surface through the tubing string 11. In the second lift position gas G, from a second source from the wellbore annulus 13, is directed up the tubing string 11 to lift accumulated wellbore fluid to the surface such fluids including liquid oil and water L while production is temporarily blocked.

Figure 3B:
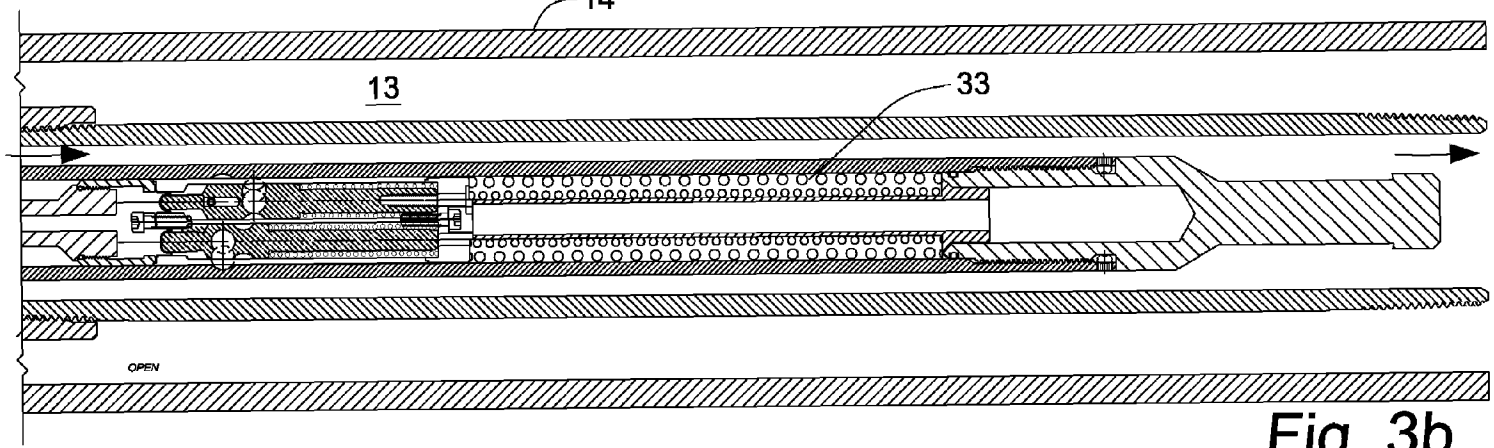

As shown in FIGS. 2*a* and 2*b*, in the production position, normally liquids L are directed to bypass the valve 10 and accumulate in the tubing bore 12. As shown in FIGS. 3*a* and 3*b* in the lift position, periodically, the valve 10 is opened to direct the pressurized gas G in the wellbore annulus 13 into the tubing string to lift the liquids G/L. It is further advantageous to keep the valve 10 open for an effective duration until the fluid pressure of the gas G in the wellbore annulus 13 falls to a specified lower and differential fluid pressure. Thus, and referring once again to FIGS. 1*a* and 1*b*, the valve 10 has a first closed or closing pressure P1 with a duration therebetween in which the valve remains closed and a second opening pressure P2 with a duration therebetween in which the valve remains open.

In this embodiment the valve 10 controls only the flow of pressurized gas G between the wellbore annulus 13 and the tubing bore 12. An additional one-way valve 16 is provided in the valve housing below the differential pressure valve 10 to prevent pressured gas from the wellbore annulus 13 from flowing back to the downhole zone of the wellbore 9 below the packer 15 when the valve 10 is open to flow pressurized gas into the tubing string 11.

The tubing string 11 extends downhole through a wellbore 9 forming the wellbore annulus 13. The tubing string 11 comprises a valve housing 20 at a downhole end. The packer 15 seals between the valve housing 20 and the casing 14 of the wellbore 9 for separating a downhole producing zone of the wellbore 9 from the wellbore annulus 13. The packer 15 is shown in fanciful schematic form only and is positioned closely above a plurality of perforations (not shown) in the casing 14.

As shown in FIGS. 2*a* and 2*b*, the valve housing 20 has a production inlet 19 at a downhole end. The one-way valve for admitting a flow of production fluid uphole into the tubing string 11. The valve 10 is situated in the bore 12 of the tubing string 11 above the one-way valve 16 forming a production annulus 23 about the valve 10. The valve 10 is supported in the valve housing 20. Wellbore production fluid L can flow uphole through bypass passages 21 formed in the valve housing 20 and which are contiguous with the production annulus 23.

The valve 10 itself comprises a valve body 22 having a fluid inlet 24 and a fluid outlet 26. For this embodiment, the valve body 22 is sealingly engaged with the valve housing 20 at the bypass passages 21. The valve body 22 has a fluid bore 27. The fluid inlet 24 communicates with the fluid bore 27. The fluid inlet 24 extends through the valve body 22 from the fluid bore 27 and aligns with one or more inlet passages 28 through the valve housing 20 to the wellbore annulus 13 external to the valve housing and isolated from the production annulus 23. The bypass passages 21 isolate production fluid 9 from the valve's fluid inlet and bore 24, 27. The bypass passages 21 are formed in a local constriction of the production annulus 23 which also supports the valve body 22. The fluid outlet 26 are one or more fluid outlet passages extending through the valve body 22 from the fluid bore 27 to the production annulus 23.

The valve body 22 is fit with annular seals 29 to seal the production annulus 23 uphole and downhole of the fluid inlet 24. In this embodiment, it is convenient to axially extend the valve body 22 to also include the one-way valve 16 downhole of the fluid inlet 24. The one-way valve 16 can be a ball and seat type valve sealingly engaging the valve housing 20 for directing production fluid 9 from the production inlet 19, through the one way valve 16 and out ports 17 in the valve body 22 into the production annulus 23 and bypass passages 21.

The valve 10 has two operating positions: firstly, as shown in FIG. 2*a*, a closed position wherein the fluid outlet 26 is closed avoid interfering with the wellbore driven flow of production fluid 9 to the production annulus 23 and secondly, as shown in FIG. 2*b*, in an open position wherein the fluid outlet 26 is unblocked to direct pressurized gas from the wellbore annulus 13 in the production annulus 23. Compared in FIGS. 2*a* and 3*a*, the valve's fluid outlet 26 is alternatively closed (FIG. 2*a*) and opened (FIG. 3*a*) through the action of a main piston. A plunger 30, supported on a cylindrical main piston 31, is axially movable in a cylindrical bore 32 of the valve body 22. The main piston 31 manipulates plunger 30 sealably across the fluid outlet 26. Fluid pressure from the fluid inlet 24 acts on pressure face of the main piston 31 for urging the main piston axially in the main piston bore 32 to unblock the fluid outlet 26. As shown in FIGS. 2*b*,3*b*, the main piston 31 is biased by a spring 33 against the fluid pressure in fluid bore 27 for returning the main piston plunger 30 and blocking the fluid outlet 26 when the force generated by the fluid pressure falls below the biasing force. The plunger 30 and main piston 31 reciprocate axially within the fluid bore 27 and main piston bore 32 respectively to alternately unblock and block the fluid outlet 26.

The main piston 31 can be releasably locked in the open position and releasably locked in the closed position. In this embodiment, at a preset, specified high pressure (HP) P2 in the fluid bore 27, the main piston 31 is unlocked to enable movement to the open position and then is locked in the open position. At a preset low pressure (LP) P1 in the fluid bore 27, the main piston 31 is unlocked to enable movement to the closed position and then is locked again in the closed position until the pressure, in the fluid bore 27, increases again to the first high pressure at which point the sequence can be repeated.

While the illustrated embodiment opens the valve 10 at high pressure, the converse is equally applicable. Depending on the arrangement of the fluid outlet 26, and whether the main piston 31 covers or uncovers the fluid outlet 26 when moved in one particular direction, the reciprocating motion of the main piston 31 can be seen to close and open the fluid outlet 26 or to conversely open and close the fluid outlet with the same unidirectional movement. Accordingly, the main piston 31 is pressure-range delimited to move or shift to a first position at a first pressure P1 and to shift to return to a second position P2 at a second pressure. Simply, the main piston 31 remains locked in each respective position until the specified first P1 or second pressures P2 are reached.

In the particular embodiment illustrated in FIGS. 2*a*-3*b*, the movement of the main piston 31 to the first position results in a closed position and movement of the main piston to the second position results in an open position.

Figure 4A:
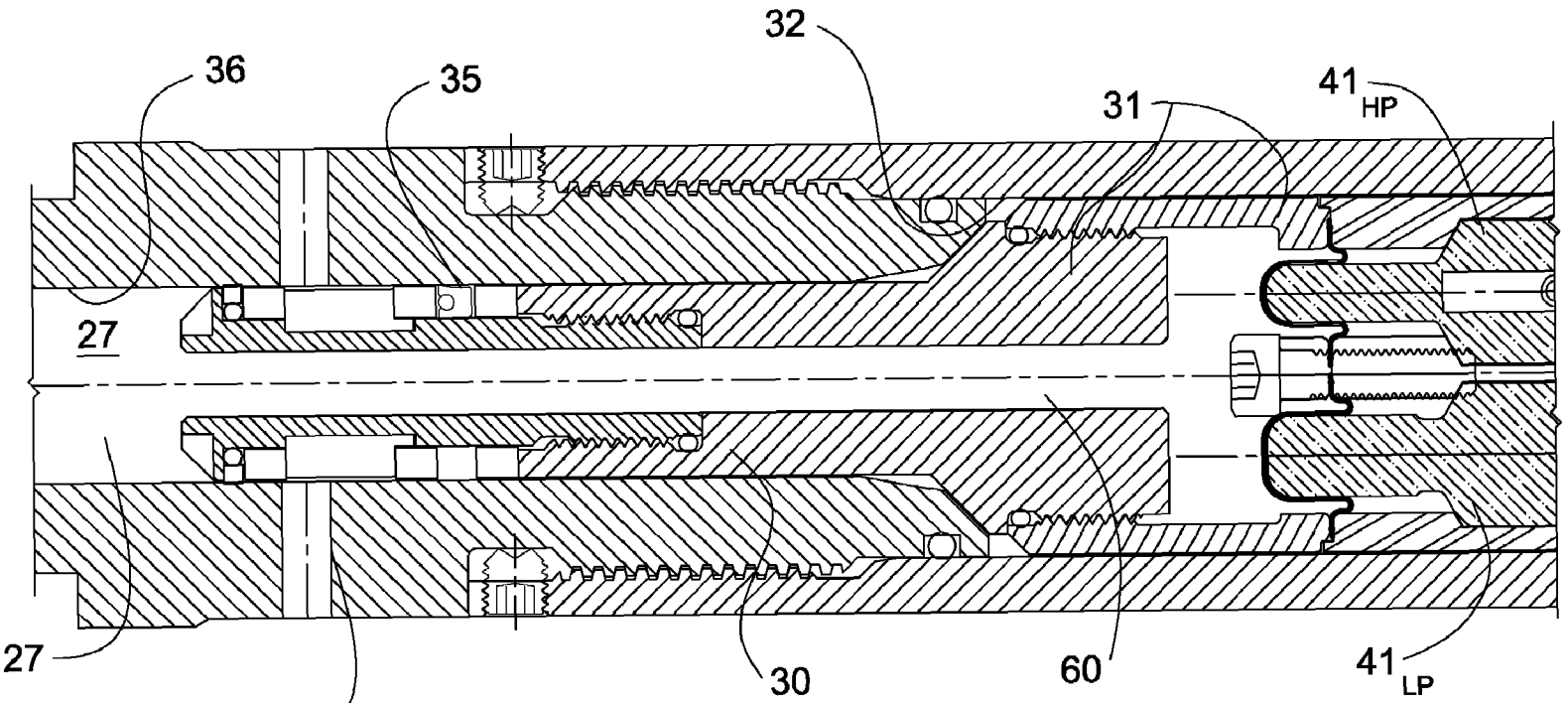
FIGS. 4*a* and 4*b* are a partial cross-sectional views of plunger of the main piston and the first and second trigger pistons in the main piston respectively according to FIGS. 2*a*,2*b;*
Figure 4B:
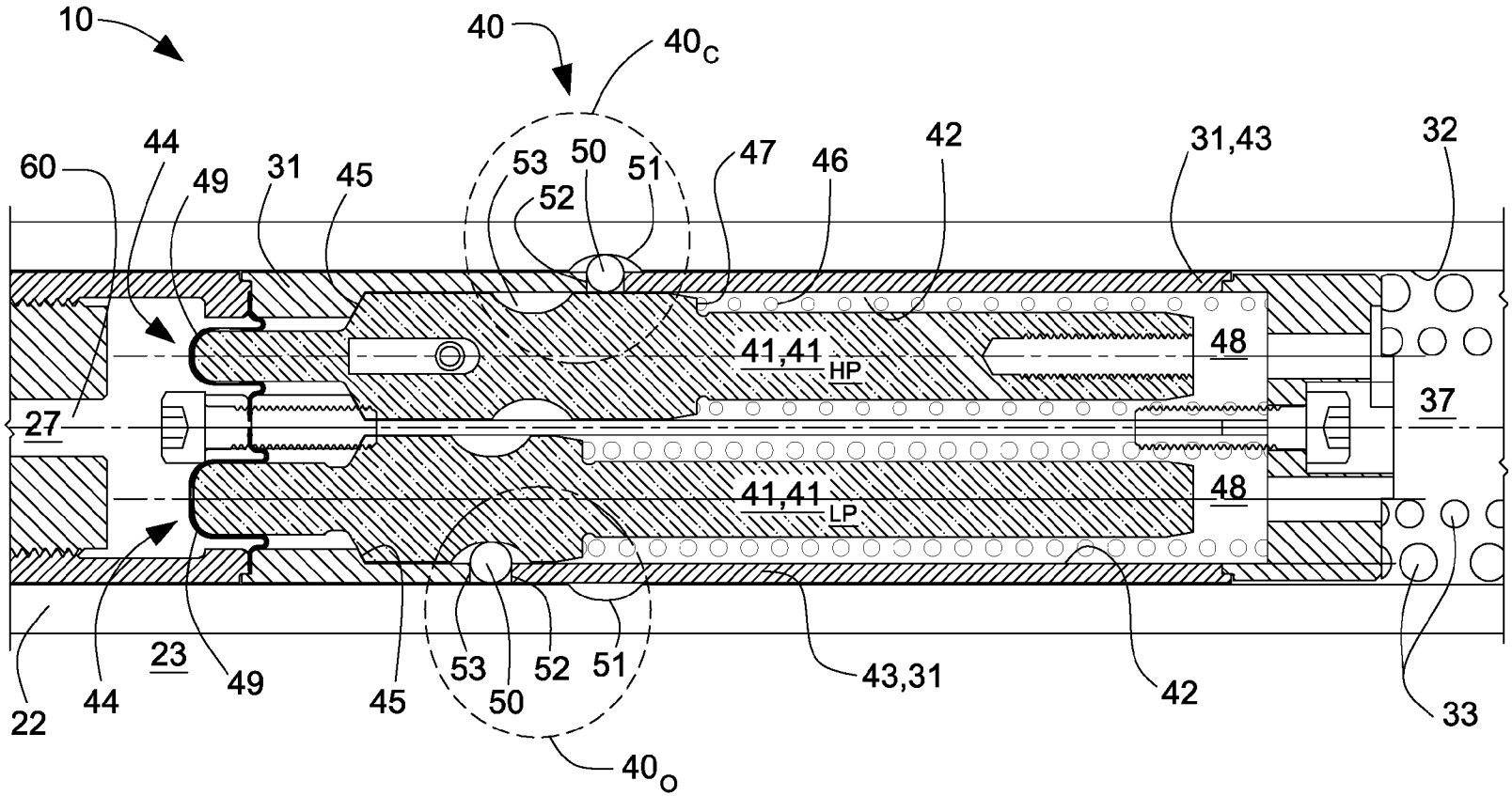

With reference also to FIGS. 4*a*,4*b*, the main piston 31 comprises a cylindrical piston body which is alternately locked and unlocked from the valve body 22 through releasable locking means 40 which are triggered by the first and second pressures P1,P2. While unlocked, the main piston 31 is axially movable to shift between the open and closed positions within the main piston bore 32 of the valve body 22. The main piston 31 is biased by spring 33 to the first closed position (FIGS. 2*a*,2*b*) and is actuated by pressure in fluid bore 27 to the second open position (FIGS. 3*a*,3*b*). The pressure face of the main piston 31 is sealed at the plunger 30 by one or more seals 35 in the plunger bore 36 as shown or in the main piston bore. Thus the spring side of the main piston 31 is in a sealed chamber 37 at known nominal pressure wherein the actuation pressure at which the force of the biasing spring 33 is overcome is a known value.

The locking means 40 releasably locks the main piston 31 to the valve body 22. The locking means 40 comprises a closed locking means 40*c* and an open locking means 40*o*. As shown in FIG. 4*b*,2*a*, the closed locking means 40*c* is engaged with the valve body 22, locking the main piston 31 thereto and preventing further axial movement until released. The open locking means $\mathbf{40}_o$ is temporarily disabled. As shown in FIG. 3*a*, the open locking means 40*o* is engaged with the valve body 22, locking the main piston 31 thereto and preventing further axial movement until released.

Best seen in FIG. 4*b*, the closed and open locking means 40*c*,40*o* can be similar apparatus, each of said closed and open locking means 40*c*,40*o* comprising a trigger piston 41 axially movable within a trigger piston bore 42 formed within the main piston 31. The trigger piston bores 42 are arranged adjacent a side wall 43 of the main piston 31. The trigger piston bores 42 are in fluid communication with the main piston bore 32 and the fluid bore 27 are thereby similarly influenced by fluid pressure acting on the main piston 31. The trigger pistons 41 are normally axially movable in their respective bores 42 however are also alternately and releasably locked to the main piston 31. Fluid pressure on a front pressure face 44 of a trigger piston 41 urges movement in their respective bore 42. Each trigger piston 41 is biased by a trigger spring 46 acting against fluid pressure to normally seat the trigger piston 41 against a stop 45. Each spring 46 is situate in its respective trigger piston bore 42 and bears against a back face 47 of the trigger piston. The pressure face 44 of each trigger piston is sealed to the bore 42. Thus the spring side of the trigger pistons are in sealed chambers 48 at known nominal pressure wherein the actuation pressure at which the force of the biasing spring is overcome is a known value.

Preferably a seal 49, such as a hat-like diaphragm, extends across each trigger piston bore 42 and has sufficient range of axial motion to enable movement of its respective trigger piston 41 in the bore 42.

The trigger pistons 41 and bores 42 can be arranged in any manner within the main piston 31. As shown in FIGS. 2*a*-4*b*, two trigger pistons 41,41 are illustrated positioned laterally in a side-by-side arrangement. As shown in an alternate embodiment of FIG. 5, two trigger pistons 41,41 can be stacked axially with fluid passages connecting each trigger piston bore 42 with the main piston bore 32.

As shown in FIGS. 4*a*,4*b*,5 and 6*a*-6*c*, relative movement between the trigger piston 41 and the main piston 31 and relative movement between the main piston 31 and the valve body 22 are determined by the locking means 40,40*c*,40*o*. The closed and open locking means 40*c*,40*o* further comprise a locking element or spherical ball 50 which cooperates with annular recesses or grooves 51, ports 52 and grooves 53 formed in each of the valve body 22, the main piston 31 and the trigger pistons 53 respectively.

Figure 5:
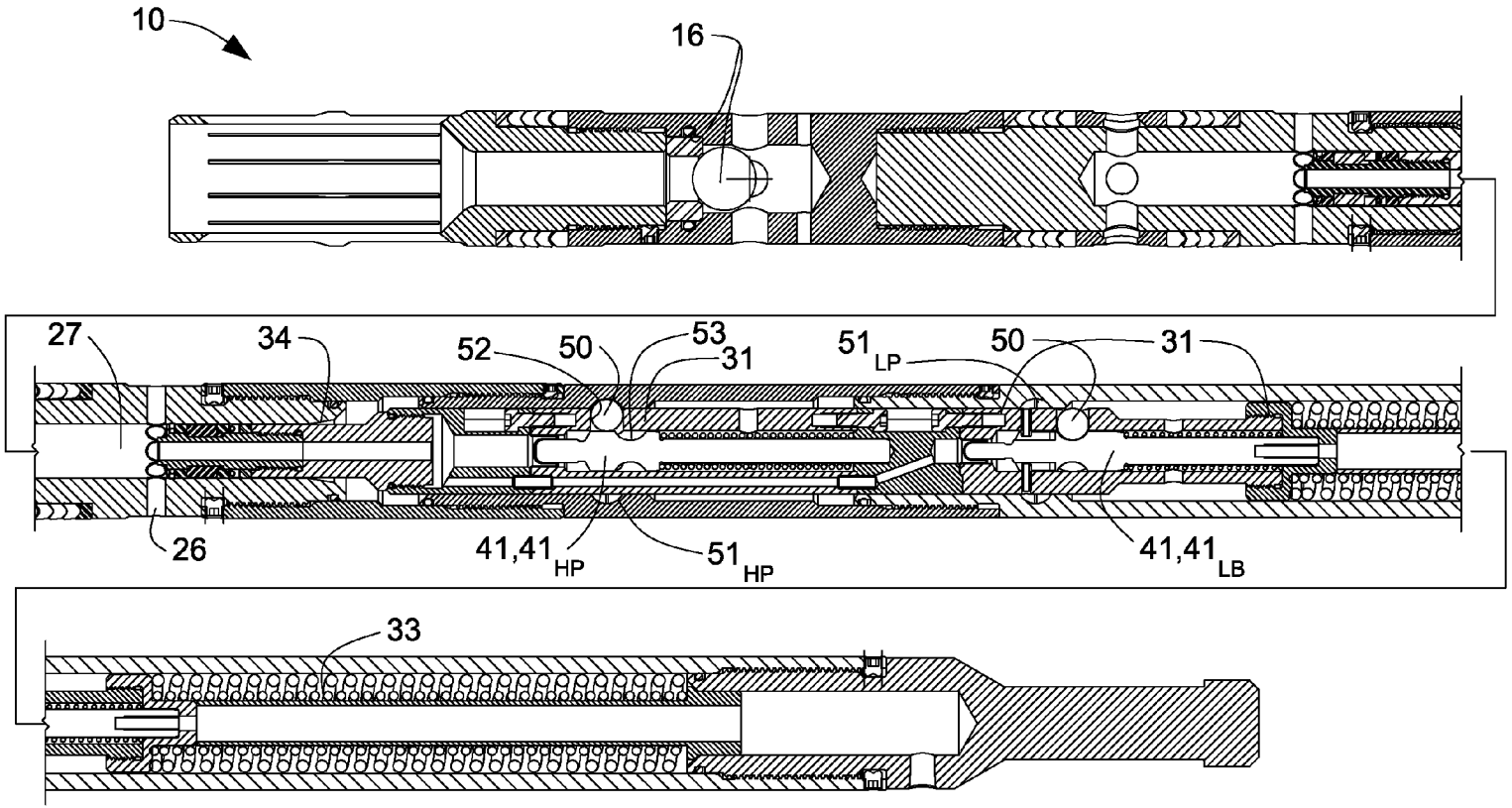
FIG. 5 is a cross-sectional view of a second embodiment of a valve having axially spaced first and second trigger pistons.

In the side-by-side arrangement of FIG. 4*b*, a first annular recess or locking groove 51 formed in the valve body 22 which is utilized by both trigger pistons 41 to lock the main piston 31 in the respective closed and opened positions. In FIG. 5, the axially stacked trigger pistons 41 utilize axially spaced locking grooves $\mathbf{51}_{HP}$, $\mathbf{51}_{LP}$ in the valve body 22, one for each trigger piston 41. In each case, the ball 50 shifts between either locking the main piston 31 to the locking groove 51 of the valve body 22 or locking the main piston 31 to the release groove 53 of the trigger piston 41.

Figure 6C:
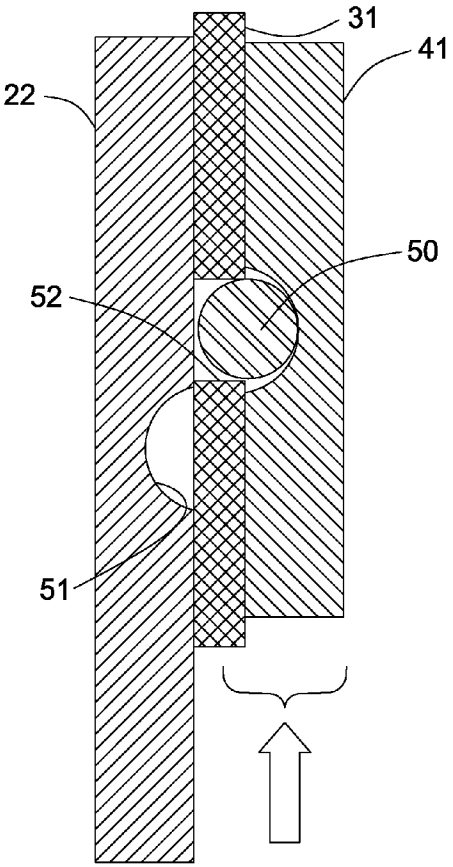
FIGS. 6*a* to 6*c* are schematic representations of the valve body, side wall of the main piston and trigger piston wherein the valve body is locked to the main piston, the annular grooves align, and the valve body is released from the main piston respectively.
Figure 6B:
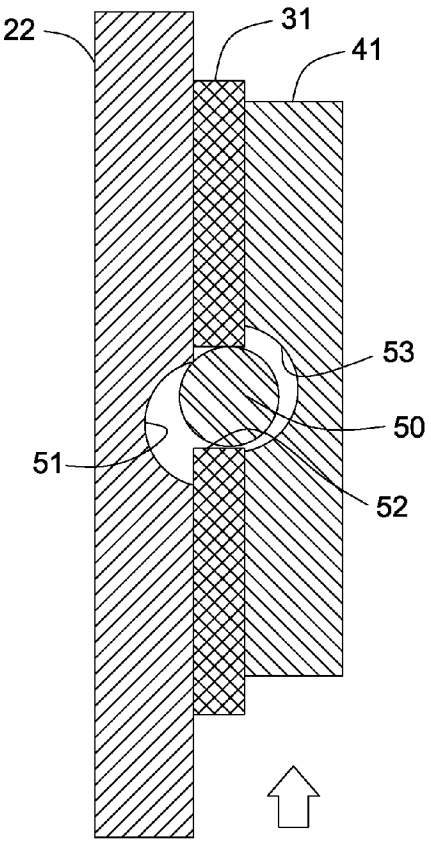
Figure 6A:
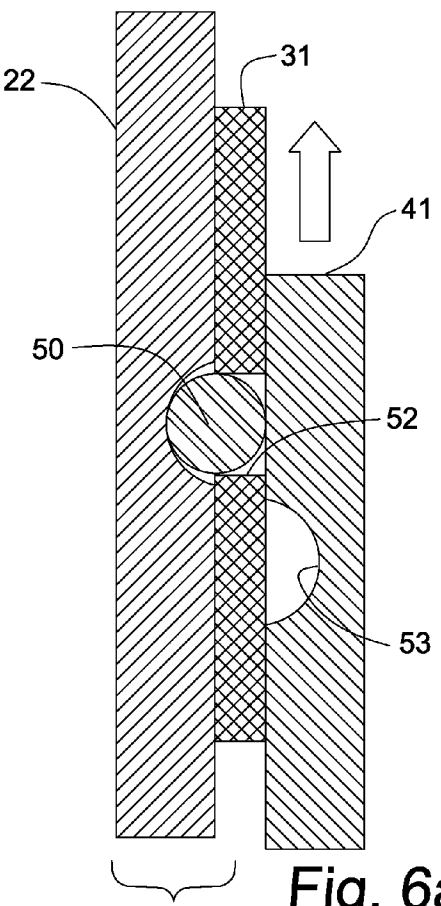

Having reference to FIGS. 6*a*-6*c*, in a schematic representation of the interface of the valve body 22, the main piston 31 and one trigger piston 41 of FIG. 4*b*, the valve body 22 is initially locked to the main piston 31 (FIG. 6*a*). The ball 50 resides in the port 52 formed in the main piston 31. The diameter of the ball 50 is greater than the depth of the port. Therefore, the ball 50 must reside and extend either partly into or out of the port 52. When extending radially outside the port 52, the ball 50 engages the locking groove 51 formed in the valve body 22 as shown in FIG. 6*a*. The trigger piston 41 is also shown with the release groove 53 formed therein. When one of the locking or release grooves 51,53 is misaligned from the port 52, the ball 50 is engaged with and trapped in the other of the release or locking groove 53,51. As shown in FIG. 6*a*, the trigger piston release groove 53 is misaligned from the main piston port 52 and the ball 50 is therefore resides in the port 52 and locking groove 51, trapped between the main piston 31 and the valve body 22, locking the main piston 31 axially to the valve body 22.

In FIG. 6*b*, switching of the locking arrangement is initiated as the trigger piston 41, while its release groove 53 is misaligned and the piston 41 is free to move axially, is urged by fluid pressure or biasing to traverse to and past the port 52, temporarily aligning with the port 52 and receiving the ball 50 for disengaging the ball from the valve body 22.

In FIG. 6*c*, the ball 50 engages the trigger piston release groove 53 and the main piston port 52 becomes misaligned from the locking groove 51, trapping the ball 50 in the release groove 53 and main piston port 52. The main piston 31 is released or unlocked from the valve body 22. The trigger piston 41 and main piston 31 shift axially past the valve body's annular locking groove 51. The valve body annular locking groove 51 is misaligned from the main piston port 52 and the ball 50 is trapped between the main piston 31 and the trigger valve release groove 53, locking the trigger piston 41 axially to main piston 31 in the axially shifted position.

Returning to FIG. 4*b*, the valve body 22 forms a cylindrical barrel forming the main piston bore 32 in which the cylindrical main piston 31 is releasably movable therein. The pair of trigger pistons 41, a HP trigger piston $\mathbf{41}_{HP}$ and a LP trigger piston $\mathbf{41}_{LP}$ are formed in side-by-side cylindrical bores 42, each of which having a wall segment 43 formed in the main piston 31 adjacent the interface or bore 32 between the main piston 31 and the valve body 22. The port 52 is formed in the wall segment 43 of each trigger piston bore 32. A ball 50 resides in each port 52.

The trigger pistons 41 have pressure faces 44 exposed to the fluid pressure in the fluid bore 27. The main piston 31 has a fluid passage 60 for fluid communication between the fluid bore 27 and the trigger pistons 41. The trigger pistons 41 are biased by the springs 43 to resist actuation of the trigger pistons 41 from the force of the fluid pressure on the pressure faces 44.

More specifically, the high pressure (HP) trigger piston $\mathbf{41}_{HP}$ is releasably movable in the trigger piston bore 42 and is actuated when the force of the fluid pressure exceeds or is less than the biasing force of spring 42. The effective diameter of the HP trigger piston $\mathbf{41}_{HP}$ and The LP trigger piston $\mathbf{41}_{LP}$ and their respective biasing springs 43 are set according to the pressure performance characteristics and can be determined by a person of skill in the art. In FIG. 4*b*, the HP trigger piston $\mathbf{41}_{HP}$ is free to reciprocate axially as the ball 50 is trapped in the port 50 between the main piston 31 and the valve body 22.

The LP trigger piston $\mathbf{41}_{LP}$ is releasably movable in the trigger piston bore 42 when the force of the fluid pressure exceeds or is less than the biasing force. In this view, the LP trigger piston $\mathbf{41}_{L}$ is locked axially in the tripper piston bore 42 as the ball 50 trapped in the port 52 between the main piston 31 and the LP trigger piston $\mathbf{41}_{LP}$.

In Operation

Figure 7:
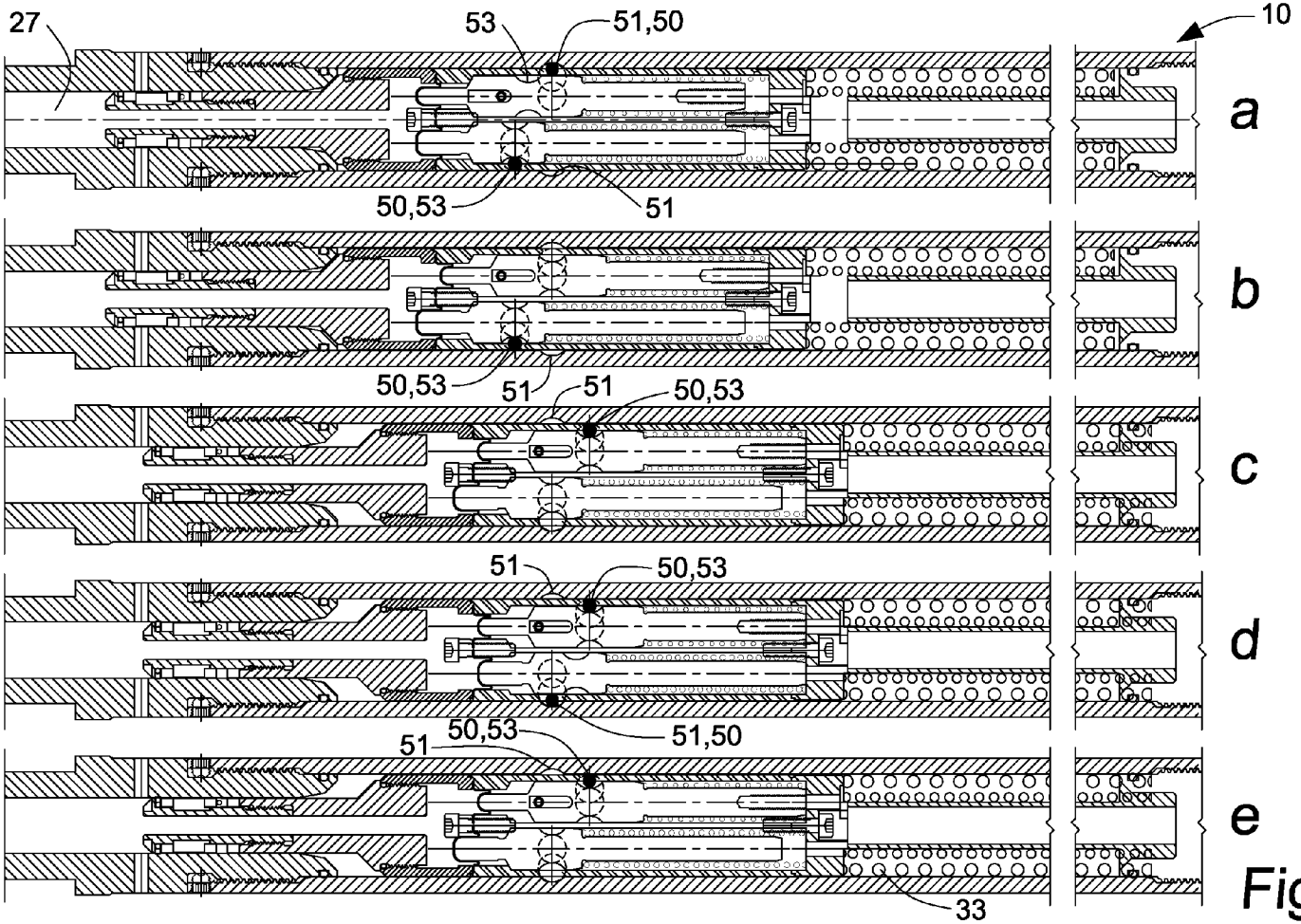
FIGS. 7*a*-7*e* are sequential cross-sectional view of the valve embodiment of FIGS. 2*a*-2*b* where the valve is locked closed until a HP is reached, the HP trigger piston is actuated to release the main piston, the main piston moved to the open position aligning the LP trigger piston, the LP trigger piston locked the main piston in the open position until a LP is reached; and the LP trigger piston is actuated to releases the main piston respectively.
Figure 8:
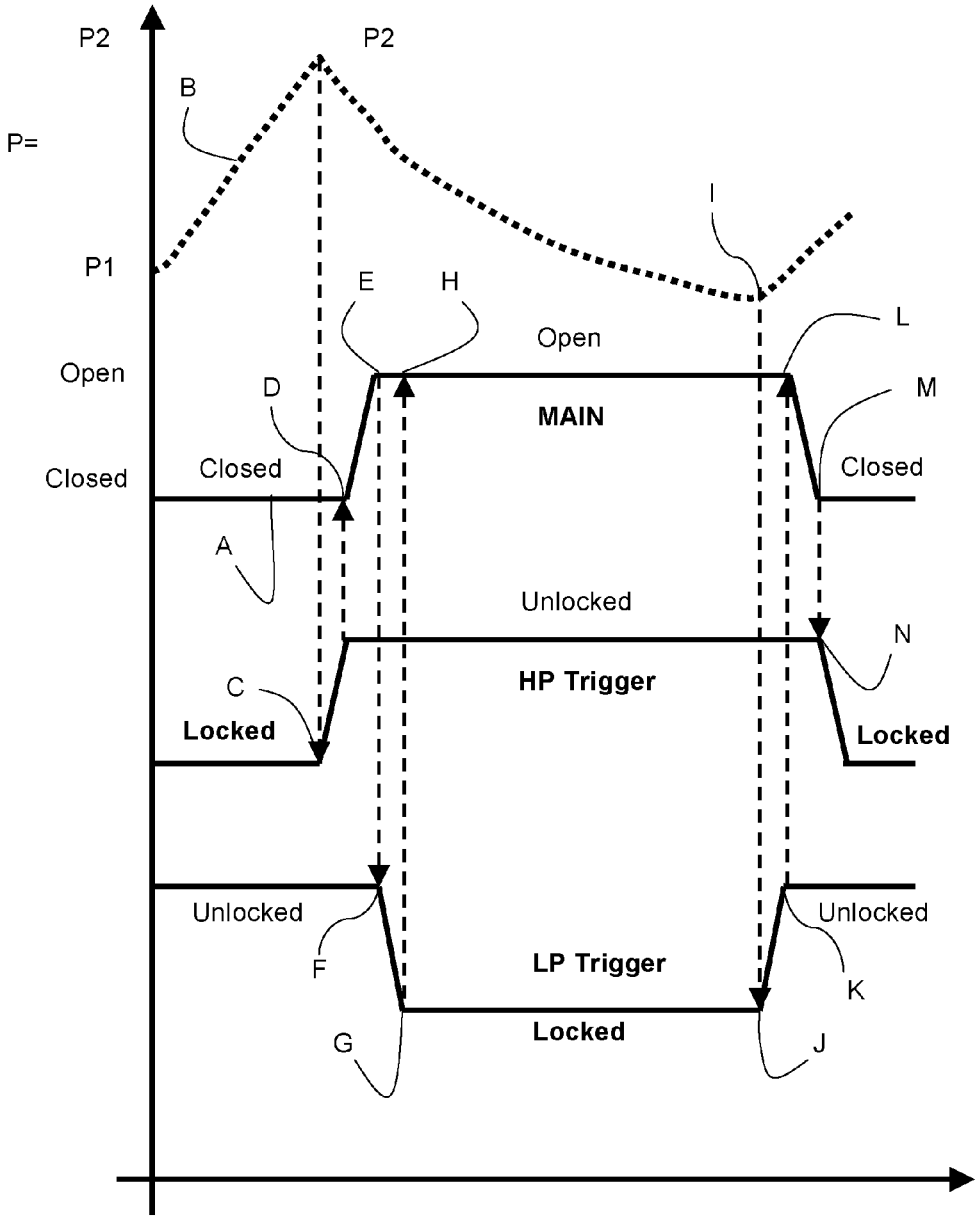
FIG. 8 is a schematic representation of the movement of the LP and HP trigger pistons and the main piston in response to pressure.

With reference to the schematic sequence of FIG. 8 and valve overview FIGS. 7*a*-7*e*, and corresponding detailed valve FIGS. 9*a*-9*e*, the valve 10 is cycled between a closed, an open and back to a closed position.

With reference to FIG. 8, initialing the sequence at some arbitrary stage, simply at (A) the main valve remains in the closed position (FIG. 7*a*) as the pressure at (B) at the fluid bore 27 rises. At P2, the HP trigger piston release groove 53 and locking groove 51 temporarily align at (C, FIG. 7*b*) to shift the ball 50 to the HP trigger piston $\mathbf{41}_{HP}$ and thereby release the main piston 31 from the valve body 22 at (D).

At FIG. 7*c*, the HP trigger piston $\mathbf{41}_{HP}$ becomes locked to the main piston 31 and under fluid pressure P2, the main piston 31 overcomes the biasing spring 33 and moves to the open position (E). Once the main piston is open, the LP trigger piston release groove and locking groove temporarily align at (F) to shift the ball 50 to the valve body 22. Under this fluid pressure the LP trigger piston continued to shift axially (see FIG. 7*d*) in the main piston 31 at (G) to lock the ball 50 in the locking groove 51 and thereby to lock the main piston 31 in the open position. While the main valve 31 is in the open position, fluid flows through the valve.

In cases wherein the pressure at the fluid inlet drops (P<P2) over time, eventually the pressure reaches a low pressure P1 at (I). At FIG. 7*e*, the LP trigger piston biasing spring 43 can now urge the LP trigger piston at (J) to move axially against the LP fluid pressure to once again temporarily align the LP trigger piston release groove 53 and the locking groove 51 at (K). The main piston is released from the valve body at (L) and the biasing spring 33 urges the main piston 31 to the closed position at (M). At FIG. 7*a*, the LP trigger piston becomes locked to the main piston 31 and the locking groove 51 and HP trigger piston release groove 53 align to allow the HP trigger piston biasing spring to urge the HP trigger piston to move axially against the LP fluid pressure to once again misalign the HP trigger piston release groove 53 and the locking groove 51 at (N) to once again lock the main piston 31 to the valve body 22, completing a cycle.

Figure 9A:
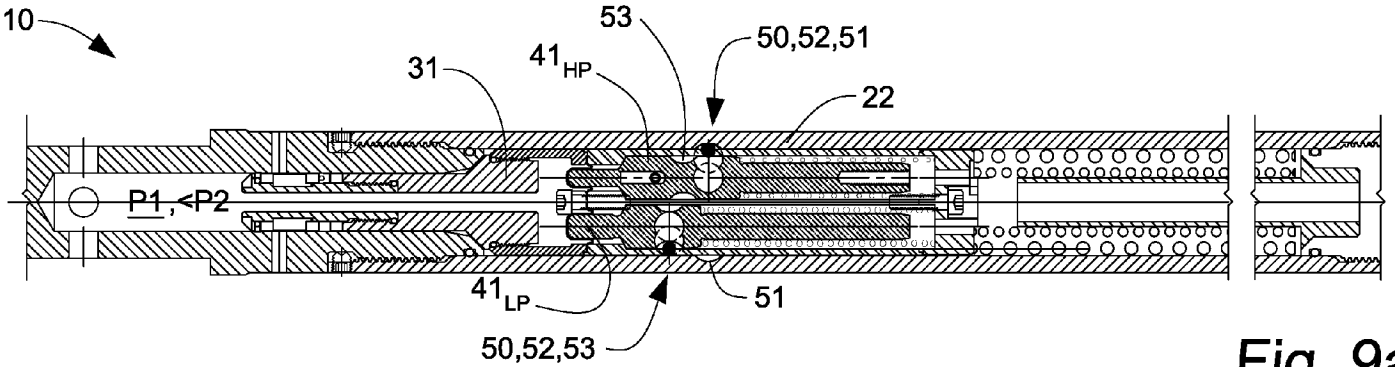
FIGS. 9*a*-9*e* are larger cross-sectional views of the valve embodiment of FIGS. 2*a*-2*b* and corresponding to sequence of FIGS. 7*a*-7*e*.
Figure 9B:
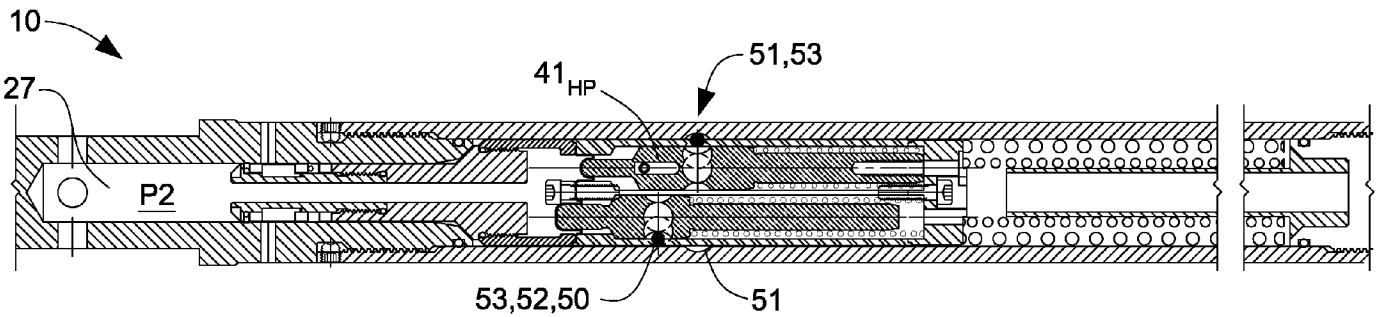
Figures 9C, 9D, 9E:
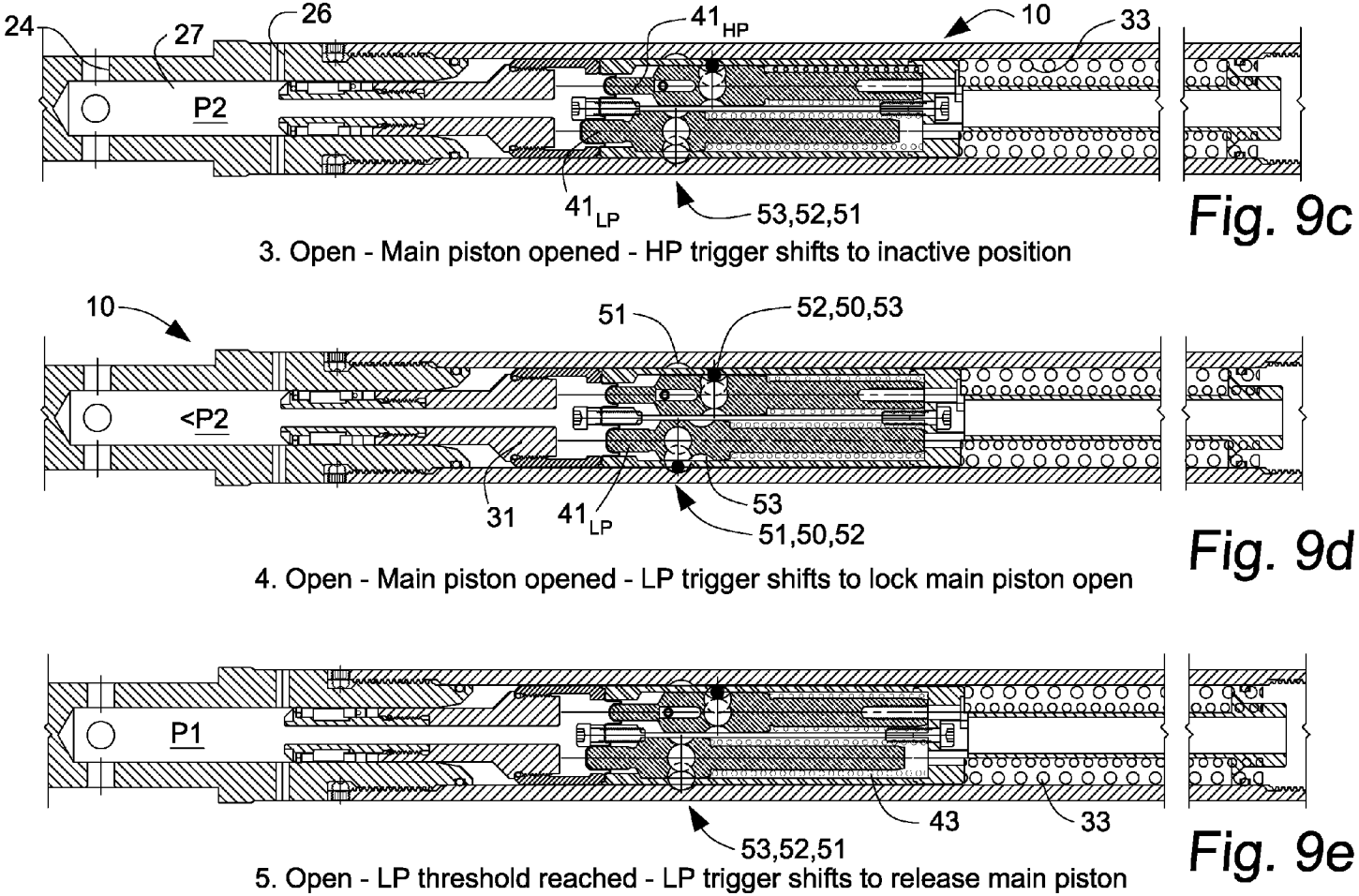

With reference to FIGS. 7*a*-7*e* and 9*a*-9*e*, as the pressure at the fluid inlet increases to at a specified preset second pressure P2, the valve is actuated (FIGS. 7*a*,7*b*,7*c* and 9*a*,9*b*,9*c*) from the closed position to the open position (FIG. 7*d*,9*d*). In this case the specified second pressure is a high pressure (HP). As the fluid pressure changes back to a first specified preset pressure, the valve 10 is actuated (FIG. 7*e*,9*e*) from the open position to the closed position (back to FIG. 7*a*,9*a*).

More particularly, in FIGS. 7*a*,9*a*, the valve 10 is closed with the main piston in a closed position. The main piston 31 is locked to the valve body 22 because the HP trigger piston $\mathbf{41}_{HP}$ traps the ball 50 in the main piston port 52 while the ball is engaged with the annular locking groove 53 of the valve body 22. The LP trigger piston $\mathbf{41}_{LP}$ is locked to the main piston 31 because the valve body 22 traps the ball 50 in the main piston port 52 and while the ball is engaged with the annular release groove 53 of the LP trigger piston $\mathbf{41}_{LP}$. The annular locking and release grooves 51,53 of the valve body 22 and the LP trigger piston $\mathbf{41}_{LP}$ respectively are misaligned and cannot align until the main piston 31 is actuated to the open position. The HP trigger piston $\mathbf{41}_{HP}$ is unlocked and reactive to fluid pressure and spring biasing. As shown, the fluid pressure is currently insufficient to actuate the HP trigger piston $\mathbf{41}_{HP}$ against the biasing spring 33.

As applied in the wellbore embodiment of FIG. 2*a*,2*b*, with the valve 10 in the closed position, wellbore fluid L flows upwardly though the one-way valve 16 and into the production annulus 23. Fluid pressure builds in the wellbore annulus 13 in communication with the valve 10 until the pressure reaches a threshold of the second, high pressure P2 to open the valve.

In FIGS. 7*b*,9*b*, the pressure a threshold high pressure P2 and the HP trigger piston $\mathbf{41}_{HP}$ overcomes the biasing spring to shift axially and align the release groove of the HP trigger piston $\mathbf{41}_{HP}$ and the locking groove 51 of the valve body 22. The ball 50 can move and be released from engagement the locking groove 51 by lateral movement in the port 52 to engage the trigger piston release groove 53. The main piston 31 is now unlocked from the valve body 22.

As shown in FIG. 7*c*,9*c*, the high pressure P2 acts on the main piston 31 to overcome the main biasing spring 33 to shift the main piston 31 axially to the open position, unblocking the fluid outlet 26. Fluid flows, such as HP gas, from the fluid inlet 24 and fluid bore 27 to the fluid outlet 26. Further the annular release groove 53 of the LP trigger piston $\mathbf{41}_{LP}$ aligns with the annular locking groove 53 of the valve body 22. The ball 50 moves laterally in the port 52 to reside between the locking groove 51 in the valve body 22 and the main piston 31.

As shown in FIG. 7*d*,9*d*, the LP trigger piston $\mathbf{41}_{LP}$ is released for movement. The fluid pressure actuates the LP trigger piston $\mathbf{41}_{LP}$ to shift axially and misalign the annular release and locking grooves 53,51, locking the main piston 31 to the valve body 22 in the open position. The LP trigger piston $\mathbf{41}_{LP}$ is unlocked and reactive to fluid pressure and biasing spring 43.

Again, in the wellbore embodiment as shown in FIG. 3*a*,3*b*, with the valve 10 in the open position, and in the, pressurized HP fluid or gas flows from the wellbore annulus 13, though the fluid inlet 24 and out the fluid outlet 26 into the production annulus 23. The pressure of the HP gas initially exceeds the pressure of the wellbore 19 below the packer 15 and the one-way valve 16 closes. The HP gas lifts accumulated wellbore fluids L in the production annulus 23 to surface. The fluid pressure P in the valve 10 drops as the gas in the wellbore annulus 13 is exhausted. When the fluid pressure in the annulus 13 reaches a preset threshold at the first low pressure P1, the main piston closes.

More generally for the valve 10, as shown in FIGS. 7*e*,9*e*, when the fluid pressure in the fluid bore 27 reaches the preset threshold low pressure P1, the spring biasing the LP trigger piston $\mathbf{41}_{LP}$ can now return the LP trigger piston $\mathbf{41}_{LP}$ to align the annular release groove 53 with the locking groove 51. The ball 50 can move to reside between the main piston 31 and the LP trigger piston 41, unlocking the main piston 31 from the valve body 33. The large spring 33 biasing the main piston 31 can now drive the main piston 31 to the closed position. The annular release groove 53 and annular locking grooves 51 align temporarily between the HP trigger piston $\mathbf{41}_{HP}$ and valve body 22 for permitting the ball 50 to move and release the HP trigger piston $\mathbf{41}_{HP}$ from main piston. The ball moves to reside between the main piston 13 and the valve body 22. While this intermediate step is not shown, the biasing spring urges the HP trigger piston $\mathbf{41}_{HP}$ to traverse past the port and retain the ball between the main piston 31 and valve body 22 once again in the locked position as shown once again in FIGS. 7*a*,9*a*.

Although the valve 10 has been described mostly in the context of a downhole wellbore embodiment, those skilled in the art will recognize that the valve can be applied in other implementation and in housing arrangements inlets, outlets and locking arrangements. Various substitutions and modifications of the invention may be made without departing from the scope of the invention as defined by the claims as defined herein.

What is claimed is:

1. A method for controlling flow through a valve comprising:

providing a valve body having an inlet and an outlet and a main piston axially movable in a valve bore in the valve body between an open position wherein the inlet is in fluid communication with the outlet and a closed position wherein the main piston blocks the outlet from the inlet, a first high pressure (HP) trigger piston movable within the main piston and in fluid communication with the inlet and providing a first locking element movable to alternately straddle to engage between a first release recess in the HP trigger piston and a first port in the main piston and straddle to engage between the first port and at least one annular locking groove in the valve body, and a second low pressure (LP) trigger piston movable within the main piston and in fluid communication with the inlet and providing a second locking element movable to alternately straddle between an annular second release recess in the LP trigger piston and a second port in the main piston and between the second port and the at least one annular locking groove in the valve body;

mechanically biasing the main piston to overcome fluid pressure at the inlet when the fluid pressure is below about a preset high fluid pressure for urging the main piston to the closed position;

mechanically biasing the HP trigger piston to overcome fluid pressure at the inlet at fluid pressures lower than about the preset high fluid pressure for urging the HP trigger piston to misalign the first release recess from the first port;

mechanically biasing the LP trigger piston to overcome fluid pressure at the inlet at about a preset low fluid pressure for urging the LP trigger piston to align the annular second release recess with the second port, the preset low fluid pressure being at a differential and lower fluid pressure than the preset high fluid pressure;

aligning the first port with the at least one annular locking groove in the closed position;

mechanically biasing the HP trigger piston to overcome the fluid pressure at the inlet for shifting the HP trigger piston to temporarily misalign the first release recess from the first port wherein the first locking element engages between the at least one locking groove and the first port for releasably locking the main piston to the valve body in the closed position and wherein the HP trigger piston is moveable in the main piston;

overcoming the mechanical biasing of the HP trigger piston at about the preset high fluid pressure for shifting the HP trigger piston to shift and temporarily align the first release recess with the first port wherein the first locking element engages between the first release recess and the first port and disengages the at least one locking groove for releasing the main piston from the valve body; and overcoming the mechanical biasing of the main piston at about the preset high fluid pressure for shifting the main piston to the open position and misaligning the at least one locking groove and the first port for locking the HP trigger piston in the main piston;

aligning the second port with the at least one annular locking groove when the main piston is in the open position for wherein the second locking element is trapped in the second port and engaged with the at least one annular locking groove for releasably locking the main piston to the valve body in the open position and wherein the LP trigger piston is moveable in the main piston;

overcoming the mechanical biasing of the LP trigger piston at fluid pressures above about the second preset fluid pressure for shifting the LP trigger piston for misaligning the second release recess and the second port;

mechanically baising the LP trigger piston to overcome the second preset fluid pressure at about the second preset fluid pressure for shifting the LP trigger piston to temporarily align the second release recess with the second port wherein the second locking element engages between the second release recess and the second port and disengages the at least one annular locking groove for releasing the main piston from the valve body and locking the LP trigger piston to the main piston; and mechanically biasing the main piston for shifting the main piston to the closed position and misaligning the at least one annular locking groove and the second port for locking the LP trigger piston in the main piston.

2. The method of claim 1 wherein the at least one annular locking groove is one locking groove and the HP trigger piston and the LP trigger piston are side-by-side.

3. The method of claim 1 wherein the at least one annular locking groove is two locking grooves.

4. The method of claim 1 wherein the at least one annular locking groove is two locking grooves and the HP trigger piston and the LP trigger piston are spaced axially within the main piston.

5. A valve comprising:

a valve body having an inlet and an outlet;

a main piston axially movable in a valve bore between an open position wherein the inlet is in fluid communication with the outlet and a closed position wherein the main piston blocks the outlet from the inlet, the main piston comprising a first internal bore which is in fluid communication with the inlet, a side wall and a first port positioned through the side wall between the first internal bore and the valve body for alignment with the at least one annular locking groove in the closed position, and a second internal bore which is in fluid communication with the inlet, a second port positioned through the side wall between the second internal bore and the valve body for alignment with the at least one annular locking groove in the open position, and locking means for releasably locking the main piston to the valve body, wherein at a first high preset fluid pressure at the inlet, the locking means releases the main piston from the valve body for permitting the main piston to move to the open position, and locking the main piston to the valve body in the open position, and at a low second preset fluid pressure at the inlet, the locking means releases the main piston from the valve body for permitting the main piston to move to the closed position, and locking the main piston to the closed position, the locking means comprising at least one annular locking groove formed in the valve bore;

a first locking member in the main piston to releasably engage the at least one annular locking groove for locking the main piston to the valve bore in the closed position and for releasing therefrom; and a second locking member in the main piston to releasably engage the at least one annular locking groove for locking the main piston in the open position and for releasing therefrom; and wherein the first locking member further comprises a first trigger piston axially movable in the first internal bore between two positions wherein at the first preset fluid pressure a first locking element engages the at least one annular locking groove through the first port and at the second preset fluid pressure the first element is released from the at least one annular locking groove for permitting the main piston to move to the open position, and locking the main piston to the valve body in the open position, and wherein the second locking member further comprises a second trigger piston axially movable in the second internal bore between two positions wherein at the second preset fluid pressure a second locking element engages the at least one annular locking groove through the second port and at the first preset fluid pressure the second locking element releases from the at least one annular locking groove for permitting the main piston to move in the closed position, and locking the main piston to the closed position.

6. The apparatus of claim 5 wherein the first element is a ball positioned in the first port and radially movable therein; and the first trigger piston has a first recess which is alternately aligned and misaligned with the first port wherein in the closed position the first recess of the first trigger piston is misaligned from the first port wherein the ball straddles the first port and the at least one annular locking groove in the valve body for locking the main piston to the valve body; and in the open position, the first recess of the first trigger piston is aligned with first port wherein the ball straddles the first port and the first recess for unlocking the main piston from to the valve body.

7. The apparatus of claim 6 wherein:

the second element is a ball positioned in the second port and radially movable therein; and the second trigger piston has a second recess which is alternately aligned and misaligned with the second port wherein in the closed position the second recess of the second trigger piston is aligned with second port wherein the ball resides in second port and the second recess in the second trigger piston for unlocking the main piston from the valve body, and in the open position, the second recess of the second trigger piston is misaligned from the second port wherein the ball resides in the second port and the at least one annular locking groove in the valve body for locking the main piston to the valve body.

8. The apparatus of claim 7 wherein the first and second recesses are circumferential grooves.

9. The apparatus of claim 7 wherein:

the first internal bore is positioned adjacent the second internal bore;

in the closed position the first port is aligned with the at least one annular locking groove formed in the valve bore; and in the open position, the second port is aligned with the at least one annular locking groove formed in the valve bore.

10. The apparatus of claim 7 wherein:

the first trigger bore is spaced axially from the second trigger bore;

in the closed position the first port is aligned with a first annular locking groove in the valve bore; and in the open position, the second port is aligned with a second annular locking groove circumferential recess formed in the valve bore.

11. A valve for alternating fluid flow from two sources under differential pressure control of the apparatus of claim 5 comprising:

a valve housing having a production bore;

a one-way valve sealably positioned in the valve housing for admitting fluid from a first source into the production bore and wherein the valve body is positioned in the production bore for forming a production annulus therebetween;

one or more inlet passages for fluidly connecting the fluid inlet to the second source external to the valve housing; and one or more outlet passages for fluidly connecting the fluid outlet to the production annulus; wherein when the main piston is in the closed position, fluid flows from the first source through the one-way valve to the production annulus, and when the main piston is in the open position, fluid flows from the second source through the one or more inlet passages to the production annulus and fluid flow to the first source is blocked by the one way valve.

12. The valve of claim 11 wherein the valve housing is located in a wellbore and forms a wellbore annulus therebetween having gas therein ranging in pressure between at least the second preset fluid pressure and at least the first preset fluid pressure.

13. The valve of claim 11 wherein the valve housing is located at the downhole end of a tubing string.

14. A valve comprising:

a valve body having an inlet and an outlet and a valve bore;

a main piston axially movable in the valve bore between an open position wherein the inlet is in fluid communication with the outlet and a closed position wherein the main piston blocks the outlet from the inlet;

a first trigger piston axially movable in a first trigger bore formed in the main piston and in fluid communication with the inlet, the first trigger bore having a first port formed through the main piston to the valve bore and the first trigger piston having a first release groove alternately aligned and misaligned with the first port, a first locking element radially moveable in the first port, and at least one annular locking groove formed in the valve bore;

a second trigger piston axially movable in a second trigger bore formed in the main piston and in fluid communication with the inlet, the second trigger bore having a second port formed through the main piston to the valve bore and the second trigger piston having a second release groove alternately aligned and misaligned with the second port, and a second locking element radially moveable in the first port;

wherein at a first preset fluid pressure at the inlet, the first port is aligned with the at least one annular locking groove, and the first release groove of the first trigger piston is moveable to misalign from the first port, wherein the first locking element resides in the first port and engages with the at least one annular locking groove for locking the main piston to the valve body in the closed position, and the second release groove of the second trigger piston can align with the second port wherein the second locking element moves to reside in the second port and engaged with the second release groove for releasing the second locking element from the valve body to release the main piston from the valve body; and wherein at a second preset fluid pressure at the inlet, the first annular groove of the first trigger piston aligns with the first port wherein the first locking element moves to reside in the first port and engages with the first release groove for releasing the first locking element from the valve body to enable the main piston to move to the open position; and the second port is aligned with the at least one annular locking groove, and wherein the second locking element resides in the second port and engages the at least one annular locking groove wherein the second trigger piston is moveable to misalign the second release groove from the second port for locking the main piston to the valve body in the open position.

15. The valve of claim 14 wherein:

the first trigger bore is positioned laterally from the second trigger bore;

in the closed position the first port is aligned with at least one annular locking groove; and in the open position, the second port is aligned with at least one annular locking groove.

16. The valve of claim 15 wherein:

the first trigger bore is spaced axially from the second trigger bore;

in the closed position the first port is aligned with a first annular locking groove; and in the open position, the second port is aligned with a second annular locking groove.

17. A method for controlling flow through a valve comprising:

providing a valve body having an inlet and an outlet and a main piston axially movable in a valve bore in the valve body between an open position wherein the inlet is in fluid communication with the outlet and a closed position wherein the main piston blocks the outlet from the inlet, a first high pressure (HP) trigger piston movable within the main piston and in fluid communication with the inlet and providing a first locking element movable to alternately straddle to engage between a first release recess in the HP trigger piston and a first port in the main piston and straddle to engage between the first port and at least one annular locking groove in the valve body, and a second low pressure (LP) trigger piston movable within the main piston and in fluid communication with the inlet and providing a second locking element movable to alternately straddle between an annular second release recess in the LP trigger piston and a second port in the main piston and between the second port and the at least one annular locking groove in the valve body;

mechanically biasing the main piston to overcome fluid pressure at the inlet when the fluid pressure is below about a preset high fluid pressure for urging the main piston to the closed position;

mechanically biasing the HP trigger piston to overcome fluid pressure at the inlet at fluid pressures lower than about the preset high fluid pressure for urging the HP trigger piston to misalign the first release recess from the first port;

mechanically biasing the LP trigger piston to overcome fluid pressure at the inlet at about a preset low fluid pressure for urging the low pressure trigger piston to align the annular second release recess with the second port, the preset low fluid pressure being at a differential and lower fluid pressure than the preset high fluid pressure;

releasably locking the main piston to the valve body in the closed position comprising shifting the main piston to the closed position, aligning the first port with the at least one locking annular groove wherein the first locking element engages therebetween and wherein the HP trigger piston is mechanically biased to overcome the fluid pressure at the inlet for shifting the HP trigger piston to temporarily misalign the first release recess from the first port for releasably locking the main piston to the valve body in the closed position;

releasing the main piston from the valve body when the fluid pressure at the inlet is at about the preset high fluid pressure comprising overcoming the mechanical biasing of the HP trigger piston with the fluid pressure for shifting the HP trigger piston to temporarily align the first release recess with the first port wherein the first locking element engages between the first release recess and the first port and disengages from the at least one annular locking groove for unlocking the main piston, shifting the main piston to the open position when the fluid pressure at the inlet is at about the preset high fluid pressure comprising overcoming the mechanical biasing of the main piston for shifting the main piston to the open position and misaligning the at least one annular locking groove and the first port for locking the HP trigger piston to the main piston, and locking the main piston to the valve body in the open position when the fluid pressure at the inlet is at about the preset high fluid pressure comprising aligning the second port with the at least one annular locking groove wherein the second locking element disengages from the first release recess and the first port and overcoming the mechanical biasing of the LP trigger piston at the fluid pressure for shifting the LP trigger piston for misaligning the second release recess and the second port for releasably locking the main piston in the open position releasing the main piston from the valve body when the fluid pressure is at about the preset low fluid pressure comprising mechanically biasing the LP trigger piston to overcome the fluid pressure for shifting the LP trigger piston to temporarily align the second release recess with the second port wherein the second locking element engages between the second release recess and the second port and disengages from the at least one annular locking groove; and returning the main piston to the closed position comprising mechanically biasing the main piston to overcome the fluid pressure, misaligning the second port and the at least one annular locking groove for locking the LP trigger piston to the main piston and temporarily aligning the first port and the at least one annular locking groove wherein the first locking element disengages between the first release recess and the first port and wherein the HP trigger piston is moveable in the main piston and shifts for misaligning the first release recess and the first port for releasably locking the main piston to the valve body in the closed position.

18. The method of claim 17 wherein the at least one annular locking groove is one locking groove and the HP trigger piston and the LP trigger piston are side-by-side.

19. The method of claim 17 wherein the at least one annular locking groove is two locking grooves.

20. The method of claim 17 wherein the at least one annular locking groove is two locking grooves and the HP trigger piston and the LP trigger piston are spaced axially within the main piston.

* * * * *